US008905038B2

(12) United States Patent
Lotringer

(10) Patent No.: US 8,905,038 B2
(45) Date of Patent: Dec. 9, 2014

(54) SMOKING DEVICE FOR SMOKING THROUGH A LIQUID

(71) Applicant: Noy Lotringer, Canyon Country, CA (US)

(72) Inventor: Noy Lotringer, Canyon Country, CA (US)

( * ) Notice: Subject to any disclaimer, the term of this patent is extended or adjusted under 35 U.S.C. 154(b) by 150 days.

(21) Appl. No.: 13/729,733

(22) Filed: Dec. 28, 2012

(65) Prior Publication Data

US 2014/0182606 A1 Jul. 3, 2014

(51) Int. Cl.
*A24F 1/30* (2006.01)

(52) U.S. Cl.
CPC ..... *A24F 1/30* (2013.01)
USPC ..... 131/173; 131/176

(58) Field of Classification Search
CPC ..... A24F 1/30
USPC ..... 131/173
See application file for complete search history.

(56) References Cited

U.S. PATENT DOCUMENTS

| | | | | |
|---|---|---|---|---|
| 3,805,806 | A * | 4/1974 | Grihalva | 131/173 |
| 4,682,610 | A * | 7/1987 | Freelain | 131/173 |
| 5,476,110 | A * | 12/1995 | Baig et al. | 131/173 |
| 7,404,405 | B1 | 7/2008 | Mehio | |
| 2002/0043513 | A1* | 4/2002 | Lipson | 215/388 |
| 2009/0301502 | A1* | 12/2009 | Mehio | 131/173 |
| 2010/0242973 | A1* | 9/2010 | Mehio | 131/173 |
| 2010/0326453 | A1* | 12/2010 | Chaoui | 131/173 |
| 2013/0146070 | A1* | 6/2013 | Ross | 131/173 |
| 2013/0220350 | A1* | 8/2013 | Zakayan | 131/257 |

FOREIGN PATENT DOCUMENTS

| | | |
|---|---|---|
| CN | 2074998 | 4/1991 |
| CN | 201067084 | 2/2008 |
| CN | 20183091 | 5/2011 |

* cited by examiner

*Primary Examiner* — Richard Crispino
*Assistant Examiner* — Eric Yaary

(57) ABSTRACT

The invention provides a portable hookah for smoking a smokable substance such as tobacco or medical marijuana. The device has a water jar with a handle and a perforated semispherical cover that supports a tubular cartridge. The lower end of the cartridge is inserted into the water jar so that it is immersed into the water that fills the water jar, and the upper end of the cartridge is located in the cover and contains a compartment for the heating and smoking substances. The water jar has on its outer surface a helical groove for winding and supporting a hose, the distal end of which has a mouthpiece for the smoker and is fixed to the water jar for storage and transportation. The water jar may be reusable or disposable.

2 Claims, 3 Drawing Sheets

SMOKING DEVICE FOR SMOKING THROUGH A LIQUID

FIELD OF THE INVENTION

The invention relates to smoking, in particular to a smoking device for smoking through a liquid. More specifically, the invention relates to a smoking device such as a hookah that is used for smoking, e.g., medical marijuana, through water. In particular, the invention relates to a portable, small-size hookah with a water jar that can be reusable or, if necessary, disposable.

DESCRIPTION OF THE RELATED ART

A hookah, which is also known as a water pipe, qalyā, or arghile, is a device for smoking a flavored tobacco by passing smoke through water before inhalation. Although the origin of the hookah is India, Persia, or at a transition point between these two countries, at the present time, smoking a hookah has gained popularity outside its native countries and is gaining popularity in America, Europe, Australia, Southeast Asia, and Africa.

The smoking of cannabis, also known as marijuana, is illegal in most countries. However, some governments, including the U.S. Federal Government, allow treatment with one or more specific, low doses of synthetic cannabinoids for treating one or more disorders.

The smoking of cannabis for medical purposes is reported to produce several well-documented, beneficial effects such as ameliorating nausea and vomiting, stimulating hunger in chemotherapy and AIDS patients, lowering intraocular eye pressure, treating gastrointestinal illness, producing an analgesic effect, etc.

One of the methods for administering medical marijuana is smoking through a hookah. A basic hookah contains a base, a stem or cartridge, at least one hose with a mouthpiece, and a bowl. The hookah tobacco is known as "massell" which is a mixture of a tobacco with a flavor or fruit extract. The molasses and fruit extract add a substantial amount of moisture to the massell, which is missing in conventional tobacco. The heating and smoking substances are placed into a bowl, and the end of the stem is immersed into water that is contained in a basin. The heat that ignites the massell is generally derived from coals that are positioned in the bowl above the massell on perforated foil. The heat from the lighted coals travels through the holes in the foil to ignite portions of the massell. Particulates from the massell travel in the smoke created by the ignition down through the hookah bowl and into the hookah pipe. The stem transports the massell smoke from the bowl to the water-filled base.

The massell smoke, which is cooled by the water, then returns to the stem, though not through the same entrance by which the massell smoke enters the base. From the stem, the massell smoke travels through the hose and is inhaled through a mouthpiece that is attached to the free end of the hose. The hose is needed to extend the path of the smoke in order to separate the smoke from the water and to cool the smoke that is heated by the coals.

A hookah is not generally considered to be a portable device. It weighs considerably more than conventional tobacco products and instruments, has a complex shape that contributes to mechanical misbalance, and is often loosely assembled by fit without fixation of the parts.

Therefore, there is a need for a portable hookah that is small in dimensions, can be tossed into a backpack or in a car and generally taken absolutely anywhere, e.g., to a park or a friend's place, on a trip or vacation, and everywhere else.

A portable hookah is convenient for administering medical marijuana or cannabis because it can always be at hand and smoked, e.g., for alleviating chronic pain and nausea.

Portable hookahs are known in the art and are described in some patent publications. For example, Chinese Utility Model CN201830891 published on May 18, 2011 (inventor, Zhao Lei) illustrates a portable hookah that is characterized by having an upper cover and a lower cover that are movably connected through an upper cover shaft and a lower cover shaft, a tobacco insertion nozzle water stop that is arranged on the upper cover, a water bucket that is connected with a water bucket clamp and together placed in the lower cover—the water bucket being connected with a flow-diverting body, a tobacco insertion nozzle that is placed at the upper end of the flow-diverting body, the tobacco insertion nozzle water stop being movably connected with the tobacco insertion nozzle, one end of a water pipe in the interior of the flow diverting body being connected with the tobacco insertion nozzle and the other end thereof extending into the water bucket, and a smoke vent port that is formed on the flow-diverting body. According to the inventor, this portable hookah is convenient to carry, adopts a dual-sealing structure at the tobacco insertion nozzle and the smoke vent port to avoid water leakage, and has a water and carbon dual-filtration function.

U.S. Pat. No. 7,404,405 issued on Jul. 29, 2008 to Nizar Youssef Mehio discloses a hookah containment device that allows a user to smoke a prepared hookah while walking. A portable hookah system includes a hookah and a hookah containment device that is tailored to mate with the hookah to vertically stabilize the hookah during turbulent locomotion. The hookah containment device includes a side wall that is adapted to form an interference fit with a hookah base or includes within a receiving chamber the means for releasably attaching the hookah within the interior of the hookah containment device.

Chinese Utility Model CN201067084 issued on Feb. 20, 2008 to Zedog Chen, et al, illustrates a portable pocket hookah that is provided with a hookah body. The utility model is characterized in that the upper end surface of the hookah body is provided with a cigarette-placing end and is provided with a suction rod that is capable of rotating; the upper end surface of the hookah body is also inserted with a suction nozzle with a rod; the suction nozzle with the rod is provided with an end that is connected with the tail end of the suction rod, and the hookah body is provided with a protecting cover that is matched with the hookah body.

Chinese Utility Model CN2074998 issued on Apr. 17, 1991 (inventor, Li Hongchen) illustrates a pen-type, small, fully enclosed portable hookah, which belongs to the miniature implement that is used for cleaning cigarette combustion gas and can be carried about. This portable hookah solves the problems of the existing hookah, such as large size, bulkiness, heavy weight, easy leakage, etc., and satisfies the requirement of smokers for carrying about and purifying cigarette smoke. The utility model is provided with a valve device that can make an entering cigarette pipe and a smoking pipe open or close by the displacement of a gas vent, and the valve device can prevent the filtering medium from leaking from the flue. The utility model can be used for the physical purification processing of the combustion gas from the common cigarette, which is helpful for the health of smokers and passive smokers, and utility model also can be used for writing at the same time.

US Patent Application Publication 2010242973 (published on Sep. 30, 2010; inventor, Nizar Youssef Mehio) discloses a disposable hookah bowl and a hookah bowl product that are moisture-sealed. The hookah bowl includes a tobacco compartment, an ignitable product shelf, a heat inlet seal, and a particulate outlet seal. The hookah bowl product includes the hookah bowl and a combustible product, such as massell.

SUMMARY OF THE INVENTION

The invention relates to a smoking device for smoking through a liquid, more specifically, a portable small-size hookah suitable for smoking medical marijuana, or the like.

The portable smoking device of the invention (hereinafter referred to as a "hookah") for smoking a smokable substance through a liquid (hereinafter referred to as "water") consists of the following main parts: a cup-shaped water jar having a closed bottom, a cylindrical side wall, and an open upper end; a cover that closes the open upper end of the water jar; a stem or a cartridge that is inserted into the cover and extending below the level of water in the water jar and has in its upper part a compartment for a smoking substance and a compartment for a heating substance intended for heating the smoking substance and located above the latter; and a hose that has a proximal end communicating with the interior of the water jar above the water and the distal end that has a mouthpiece for a smoker.

The hookah of the invention is characterized by having small dimensions and light weight, which allow holding it in a hand. For this purpose the water jar is provided with a handle. The cover of the water jar has a perforated, semispherical shape and serves as a wind guard for a heating substance, e.g., charcoal, located in a heating-substance compartment formed in the elongated cartridge. The cartridge is inserted into the water jar with the lower end below the water level. The water jar has on its outer surface a helical groove, and the hose is wound into the helical groove around the water jar. The inlet end of the hose is fitted onto the pipe union that extends from the overwater space of the jar interior, and the mouthpiece end of the hose is snapped into the gap of a hook-like projection that protrudes outward from the jar below the handle.

If necessary, the cover with the cartridge fixed in it can be easily separated from the water jar, and the latter can be discarded and replaced with a new one.

The hookah can be smoked with the hose in an unwound state for distancing the user from the charcoal smoke. However, since in a wound state of the hose the mouthpiece is located near the water-jar bottom, the charcoal compartment is located at the upper end of the cartridge, and since the hose has a sufficient length, the hookah can be smoked without unwinding the hose.

The device can be carried in a small bag or backpack or on a waist belt that is threaded through the handle.

DETAILED DESCRIPTION OF THE INVENTION

Figure 1:
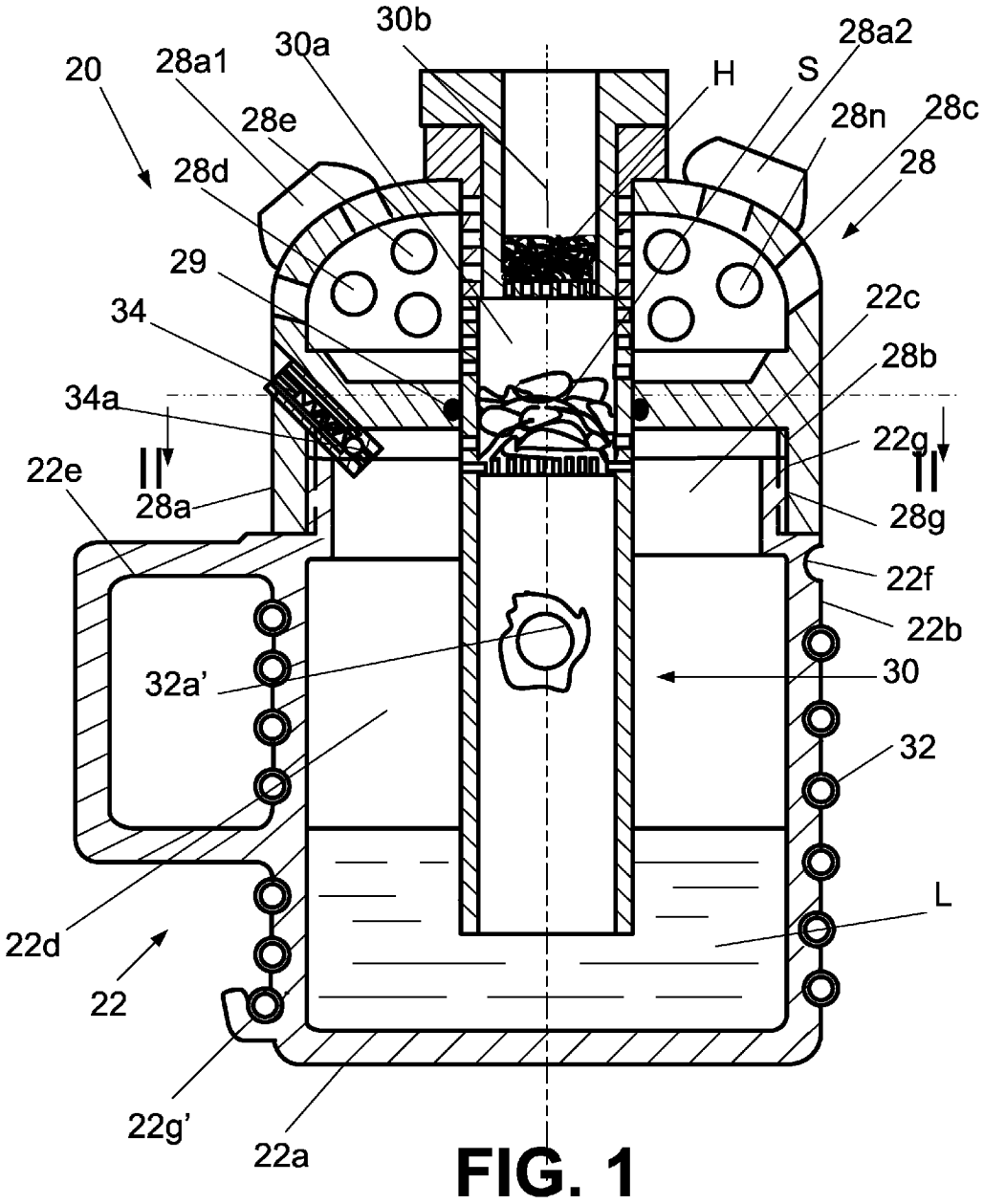
FIG. 1 is a vertical, sectional view through the portable hookah of the invention.
Figure 2:
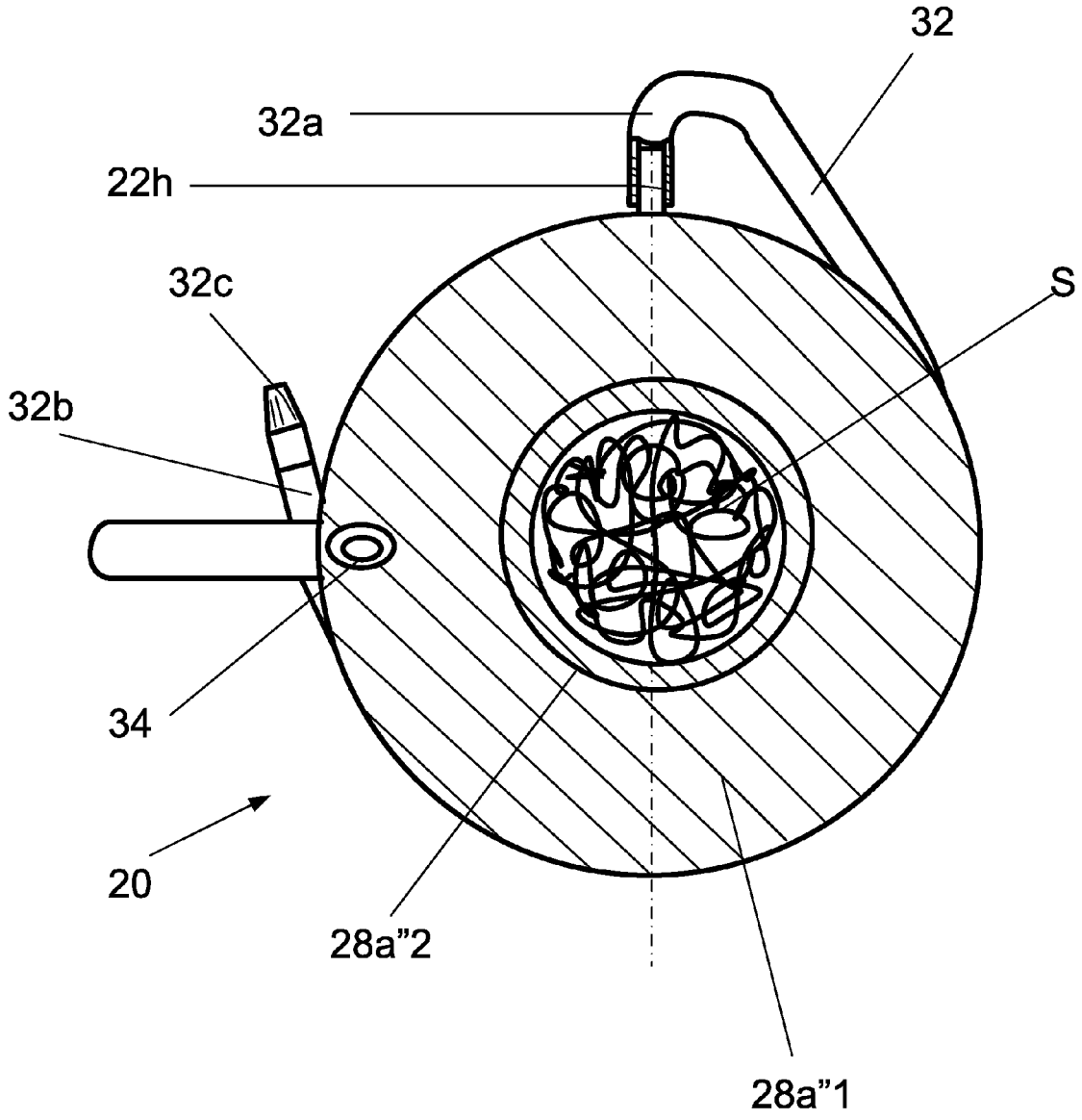
FIG. 2 is a sectional view through line II-II of FIG. 1.
Figure 3:
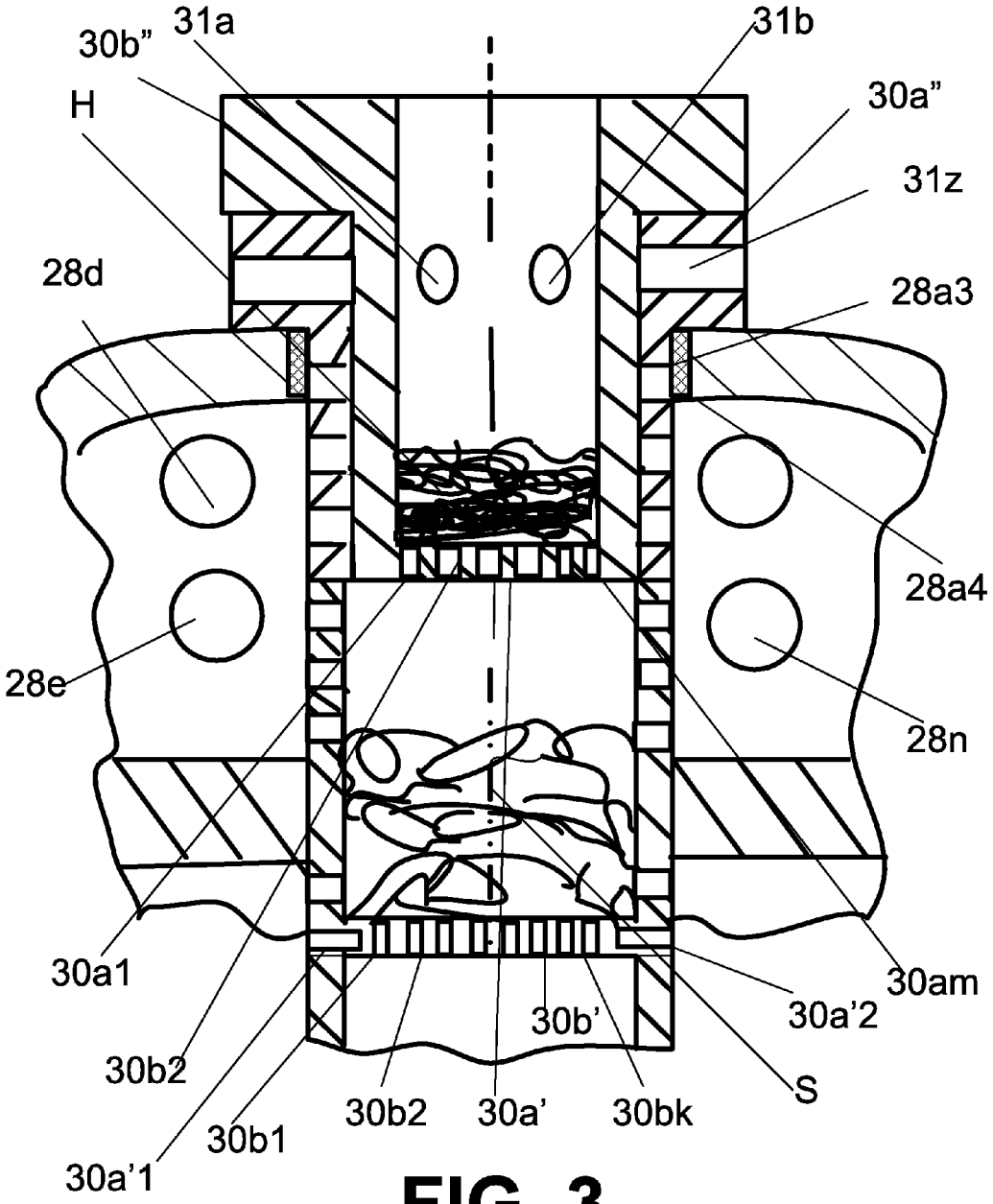
FIG. 3 is a fragmental, sectional view of an upper part of the cartridge used in the hookah of the invention shown on a larger scale.

The portable hookah of the invention, which hereinafter sometimes is referred to as a "device", will now be described in more detail with reference to the accompanying drawings, wherein FIG. 1 is a vertical, sectional view through the portable hookah of the invention, and FIG. 2 is a sectional view through line II-II of FIG. 1. FIG. 3 is a fragmental, sectional view of an upper part of the cartridge used in the hookah of the invention shown on a larger scale.

As can be seen from FIGS. 1 and 2, the device, which as a whole is designated by reference numeral 20, comprises the following: a container for a liquid (hereinafter referred to as a cup-shaped water jar 22 having a closed bottom 22*a*), a cylindrical side wall 22*b,* and an open upper end 22*c;* a cover 28 that closes the open upper end 22*c* of the water jar 22; a stem or a cartridge 30 that is inserted into the cover 28, extends down below the level of water L in the water jar 22, and has in its upper part a compartment 30*a* for a smoking substance S and a compartment 30*b* for a heating substance H intended for heating the smoking substance S and located above the latter; and a hose 32 that has a proximal end 32*a* communicating with the interior 22*d* of the water jar 22 above the water L and the distal end 32*b* that has a mouthpiece 32*c* for a smoker (not shown).

The cup-shaped water jar 22 has the shape, weight, and dimensions of a conventional mug and is provided with a handle 22*e* for holding in a user's hand. Although the handle 22*e* that extends radially outward from the side wall is shown as a closed-loop handle, such a shape is shown only as an example. The water jar 22 has on its outer surface a continuous groove, e.g., a helical groove 22*f,* and a hook-like radial projection 22*g*' formed below the handle 22*e,* preferably close to the bottom 22*a* of the water jar 22.

The device has means for removably and sealingly connecting the cover 28 to the water jar 22. For this purpose, the cover 28 has a cylindrical portion 28*a* that is screwed with its inner thread 28*b* onto the outer thread 22*g* of the water jar 22 formed near its open end 22*c* and a semispherical top portion 28*c*. The threaded connection between the cover and the water jar provides sealing of the interior 22*d* of the water jar. The cover 28 has perforations 28*d,* 28*e,* . . . 28*n* (FIG. 3) for ventilation and access of air to the heating-substance compartment 30*b* of the cartridge 30. For convenience of screwing and unscrewing the cover 28 onto and from the water jar 22, the outer surface of the cover 28 may be provided with wings 28*a*1 and 28*a*2 (FIG. 1).

The cover 28 is also provided with a check valve 34 (FIG. 1) that is installed in the side wall of the cover 28 and has a spring-loaded ball 34*a* that allows release of a portion of a gaseous medium from the interior 22*d* of the water jar 22 above the water L into the atmosphere when the pressure of the gaseous medium in this interior exceeds a predetermined level. The structure of such a check valve is conventional and is beyond the scope of the present invention.

The cover 28 has a transverse plate 28*a*"1 with a central opening 28*a*"2 for supporting the tubular cartridge 30, as well as for sealing the interior 22*d* of the water jar 22 above the water L from communication with the atmosphere. Reference numeral 23 designates a seal ring (FIGS. 1 and 2) installed in the central opening 28*a*"2 for sealing the area of contact with the tubular cartridge.

The cartridge 30 comprises a hollow, elongated tube. At least an upper portion of the cartridge that contains the compartment 30*a* for a smoking substance S and a compartment 30*b* (FIG. 1) for a heating substance H is made from a metal or another heat-resistant material (FIG. 3). The compartment 30*a* has the shape of a sleeve, with the closed bottom portion 30*a*' having a plurality of perforations 30*a*1, 30*a*2, . . . 30*am.* The compartment 30*a,* which is integrally connected to the cartridge 30, may be press-fitted into the central opening 28*a*3 of the cover 28 or may be glued or welded to it at 28*a*4 (FIG.

3) and is provided with a flange 30*a*" that rests on the upper surface of the semispherical top portion 28*c* of the cover 28. As a result, the cartridge appears to be integrally connected to the cover and is extracted from the water jar when the cover is disconnected from the latter. The smokable substance S is supported by the perforated bottom portion 30*a*'. The perforated bottom portion 30*a*' may comprise a disk-like plate fixed in place inside the hollow cartridge, e.g., by pins 30*a*'1 and 30*a*'2.

The heat-substance compartment 30*b*, which is made from a metal or another heat-resistant material, also is the shape of a sleeve, with a perforated bottom portion 30*b*' having a plurality of perforations 30*b*1, 30*b*2, . . . 30*bk*. The compartment 30*b* may be removably fitted into the central opening of the smoking-substance compartment 30*a* or threaded into it by a thread (not shown). The compartment 30*b* is provided with a flange 30*b*" that rests on the flange 30*a*" of the smoking-substance compartment 30*a*.

In FIG. 1, reference numeral 32*a*' designates an opening through the side wall 22*b* of the water jar 22 to the pipe union 22*h* (FIG. 2) onto which the proximal end 32*a* of the hose 32 is fitted.

Use of the device 20 of the invention is described below.

When the portable device 20 needs to be used, it is removed from a backpack, bag, pocket, or any other storage place. If the device 20 is in an assembled state, the cover 28 together with the attached cartridge 30 is disconnected from the water jar 22 by unscrewing the inner thread 28*b* of the cover 28 from the outer 22*g* of the water jar 22 (FIG. 1). The water jar is filled with water, in the illustrated case, water L, to the level sufficient to submerge the lower end of the tubular cartridge 30. The heating-substance compartment 30*b* is extracted from the smoking substance compartment 30*a*, whereby access to the latter is provided. The smoking substance compartment 30*a* is filled with an appropriate smoking substance S, e.g., medical marijuana, and the heating-substance, e.g., charcoal H, is replaced by installing it into the open end of the compartment 30*b*. The charcoal is ignited, and burning of the charcoal is maintained due to access of air to the compartment 30*b* through compartments 31*a*, 31*b*, . . . 31*z* (FIG. 3) and through the open upper end of this compartment. After the hose 32 is unwound from the helical groove 22*f* on the surface of the water jar 22, the device 20 is ready for use. If necessary, the hose 32 may remain unwound, and smoking can be carried out through the tube in the unwound state because the tube is sufficiently long and its helical shape will enhance separation of the water from the smoke.

When one inhales through the hose 32, air is pulled through the charcoal H into the bowl smoking-substance compartment 30*a*. The hot air, heated by the charcoal, vaporizes (not burns) the smoking substance, thus producing smoke, which is passed down through the perforations 30*b*1, 30*b*2, . . . 30*bk* (FIG. 3) into the interior of the water in the jar 22. The hot air bubbles up through the water, loses heat, and fills the top part of the jar 22, to which the hose 32 is attached through the pipe union 32*b* (FIG. 2). When a smoker inhales from the hose, smoke passes into the lungs, and the change in pressure in the jar 22 pulls more air through the charcoal H, continuing the process.

If the hookah 20 has been lit and smoked but has not been inhaled for an extended period, the smoke inside the water jar may be regarded as stale and undesirable. Stale smoke can be exhausted through the check valve 34. The check valve 34 is opened by the positive pressure created from gently blowing into the hose 32.

The benefits of the small portable device 20 of the invention when compared with conventional hookahs, are tastier smoke, easier transport, higher durability, easier use, and significantly lower cost.

Although the invention is described with reference to specific embodiments, these embodiments should not be construed as limiting the areas of application of the invention, and any changes and modifications are possible provided that these changes and modifications do not depart from the scope of the attached patent claims. For example, the water jar may have a shape other than the one shown in the drawings. The cover top can be cylindrical instead of semispherical. The liquid can be other than water. There may be a great variety of smoking substances, such as various mixtures and brands of mixtures and brands of tobacco. The construction of the heat-substance and smoking-substance compartments can be modified to simplify loading of the substances. The cartridge can be separated from the cover, etc.

What is claimed is:

1. A smoking device for smoking through a liquid comprising:

a container for a liquid having an interior, a closed bottom, a side wall with an outer surface, an open upper end, a handle that extends radial outward from the side wall, a pipe union that extends radially outward from the side wall in communication with the interior of the container for a liquid, and a continuous groove at least on the outer surface of the side wall;

a cover that has means for removably connecting the cover to the container for a liquid;

a cartridge sealingly inserted into the container for a liquid through the cover, the cartridge comprising a smoking-substance compartment for placing a smoking substance and a heating-substance compartment for placing a heatingsubstance located above the smoking-substance compartment, the heating-substance compartment has a perforated bottom with perforations opened into the smoking-substance compartment, and the smoking-substance compartment has perforated bottom with perforation opened into the interior of the cartridge; and a hose that is wound into the continuous groove formed on the outer surface of the side wall and has a proximal end connected to the pipe union, wherein the container for a liquid is a jar that has a cylindrical shape, the continuous groove comprises a helical groove, the jar has a thread near the upper open end and said means for removably connecting the cover to the container for a liquid comprising a thread formed on the cover for engaging the thread of the jar, and the cover has a cylindrical portion that contains said thread formed on the cover for engaging the thread of the jar and a semispherical top portion with an interior and with openings that connect the atmosphere with the interior of the semispherical portion.

2. The smoking device of claim 1, wherein the smoking-substance compartment and the heating-substance compartment have perforations that are open into the interior of the semispherical top portion.

* * * * *